US006644391B1

(12) United States Patent
Fourt et al.

(10) Patent No.: US 6,644,391 B1
(45) Date of Patent: Nov. 11, 2003

(54) SPIRAL HEAT EXCHANGER

(75) Inventors: Olivier Fourt, Nevers (FR); Philippe Maupetit, Arbourse (FR)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 10/088,621

(22) PCT Filed: Aug. 25, 2000

(86) PCT No.: PCT/SE00/01643

§ 371 (c)(1),
(2), (4) Date: Mar. 19, 2002

(87) PCT Pub. No.: WO01/22019

PCT Pub. Date: Mar. 29, 2001

(30) Foreign Application Priority Data

Sep. 20, 1999 (SE) ..... 9903367-2

(51) Int. Cl.[7] ..... F28D 7/02; F28D 7/12
(52) U.S. Cl. ..... 165/164; 165/165; 165/156
(58) Field of Search ..... 165/164, 165, 165/DIG. 398, 169, 170, 156

(56) References Cited

U.S. PATENT DOCUMENTS

| | | | | |
|---|---|---|---|---|
| 2,081,678 A | | 5/1937 | Rosenblad | |
| 2,360,739 A | * | 10/1944 | Strom | 165/165 |
| 4,089,370 A | * | 5/1978 | Marchal | 165/159 |
| 4,124,069 A | * | 11/1978 | Becker | 165/164 |
| 4,577,683 A | * | 3/1986 | Kelch | 165/164 |
| 5,242,015 A | | 9/1993 | Saperstein et al. | |
| 5,273,106 A | * | 12/1993 | Drake | 165/164 |
| 5,505,255 A | | 4/1996 | Viessmann | |

FOREIGN PATENT DOCUMENTS

| | | | |
|---|---|---|---|
| CH | 539257 | | 8/1973 |
| EP | 214589 | | 3/1987 |
| EP | 0380419 A1 | * | 8/1990 |
| GB | 24404 | | 10/1902 |
| GB | 2156961 A | * | 10/1985 |
| SE | 80107 | | 4/1934 |
| SE | 85142 | | 12/1935 |
| SE | 89372 | | 6/1937 |
| SE | 112656 | | 12/1944 |
| SE | 151318 | | 8/1955 |
| SE | 164229 | | 8/1958 |

* cited by examiner

*Primary Examiner*—Henry Bennett
*Assistant Examiner*—Tho V Duong
(74) *Attorney, Agent, or Firm*—Fish & Richardson P.C.

(57) ABSTRACT

The invention relates to a spiral heat exchanger including at least two spiral sheets (1, 2) extending along a respective spiral-shaped path about a common center axis (x) and forming at least two spiral-shaped, substantially parallel flow channels (4, 5). Each flow channel (4, 5) permits a heat exchange fluid to flow in a substantially tangential direction with respect to the center axis (x). Each flow channel includes a radially outer orifice, which forms an outlet or an inlet of the respective flow channel and which is located at a radially outer part of the respective flow channel and a radially inner orifice, which enables communication between the respective flow channel and a respective inlet/outlet chamber (13, 14). The center axis (x) extends through the inlet/outlet chamber of the radially inner orifice. The spiral heat exchanger includes a center body (3) extending around the center axis (x) and being closed with respect to the flow channels (4, 5).

11 Claims, 3 Drawing Sheets

SPIRAL HEAT EXCHANGER

BACKGROUND OF THE INVENTION AND PRIOR ART

The present invention refers to a spiral heat exchanger including at least two spiral sheets extending along a respective spiral-shaped path around a common centre axis and forming at least two spiral-shaped flow channels, which are substantially parallel to each other, wherein each flow channel includes a radially outer orifice, which enables communication between the respective flow channel and a respective outlet/inlet conduit and which is located at a radially outer part of the respective flow channel with respect to the centre axis, and a radially inner orifice, which enables communication between the respective flow channel and a respective inlet/outlet chamber, so that each flow channel permits a heat exchange fluid to flow in a substantially tangential direction with respect to the centre axis, wherein the centre axis extends through the inlet/outlet chambers at the radially inner orifice.

Such a spiral heat exchanger is disclosed in SE 151 318. This known heat exchanger is of a conventional design having a wound centre portion. The heat exchanger is obtained by joining two sheets of metal, introducing the sheets of metal in a split mandrel, and then rolling the sheets to form two concentric spiral channels. Thereafter, the split mandrel is retracted, whereby two semicircular cylindrical spaces are formed, one for each channel, in the centre of the spiral heat exchanger. In order to obtain a sufficient rigidity, stiffeners in the form of rods are frequently positioned in the semicircular spaces to extend in a substantially radial direction.

Another known spiral heat exchanger is provided with a central pipe to which the two spiral sheets are joined. The central pipe is provided with openings giving access to the two flow channels between the spiral sheets. A central sheet is introduced into the pipe in order to provide two semicircular channels providing inlet/outlet chambers for the heat exchange fluids with respect to the two flow channels. In this known design, it is difficult to obtain a proper weld joining the central sheet to the inner surface the central pipe.

SE 80 107 discloses a similar spiral heat exchanger having a central pipe which forms the outlet chamber for one of the spiral flow channels, whereas an annular chamber surrounding the central pipe forms the inlet chamber for the other flow channel.

Spiral heat exchangers are frequently used in applications where the heat exchange fluids contain fibres or other particles. In the prior art heat exchangers the stiffeners and the holes of the central pipe cause clogging of the fibres or particles, which necessitates frequent dismounting and cleaning of the heat exchanger. Also, a central pipe provided with openings is prone to erosion around the openings, especially if the heat exchange fluids contain fibres or particles.

GB 24 404 discloses another type of spiral heat exchanger having a central hollow body. However, there are no inner outlet and inlet chambers positioned in the centre of the heat exchanger. Furthermore, the inner outlet and inlet conduits extend in the same direction through one of the end plates. Due to the eccentric position of the radially inner outlet and inlet conduits, the end plate in question will be subjected to high stresses. Moreover, the design of the inlet and outlet portions of the heat exchanger of this document does not permit a smooth flow of heat exchange fluids.

SE 112 656 discloses a number of different embodiments of spiral heat exchangers, which partly are designed for an axial flow of one of the heat exchange media. A rather complicated construction for a tangential flow application has a centre body provided with inlet and outlet channels arranged within the body, and accessible through longitudinal apertures in the wall of the centre body.

EP 214 589 discloses a spiral heat exchanger having an oblong shape seen in a cross section. The heat exchanger includes a centre body which appears not to be accessible for the heat exchange fluids. However, it appears from this document that the inlet and the outlet channels are displaced with respect to the centre axis of the heat exchanger. Moreover, the design disclosed by EP 214 589 is not suitable for high pressures.

U.S. Pat. No. 4,089,370, U.S. Pat. No. 5,505,255 and U.S. Pat. No. 2,081,678 disclose spiral heat exchangers of another type, which are intended for axial flow through at least one of the flow channels.

SUMMARY OF THE INVENTION

The object of the present invention is to provide a spiral heat exchanger, which is designed for tangential flow and which remedies the disadvantages of the prior art heat exchangers referred to above. In particular, it is aimed at a spiral heat exchanger permitting a substantially unobstructed flow of a heat exchange fluid containing fibres or other particles.

This object is obtained by the heat exchanger initially defined, which is characterized in that it includes a centre body extending around the centre axis and being substantially closed with respect to the flow channels and the inlet/outlet chambers.

By providing a closed centre body, the heat exchange fluids will not reach the inner of the centre body, but the fluids may be introduced directly into the flow channels. Consequently the problems of the prior spiral heat exchanger regarding clogging of particles or fibres and erosion of the central structure may be overcome. Furthermore, by such a design the flow area of the flow channel in the inlet and outlet portions will be constant and substantially equal to the flow area in the main part of the flow channels. Thus, it is possible directly upon entry of a heat exchange fluid into the spiral heat exchanger to define an appropriate flow velocity. The flow velocity in the inner inlet and outlet portions of the prior art spiral heat exchanger is often too low, increasing the clogging problems mentioned above. It is essential that the substantially closed centre body means that it does not permit any flow of the heat exchange fluids through the centre body.

According to an embodiment of the invention, the inlet/outlet chamber at the radially inner orifice of one of the flow channels extends from said centre body in one axial direction and the inlet/outlet chamber at the radially inner orifice of the other flow channel extends from said centre body in the opposite axial direction. Consequently, it is possible to obtain two concentric inlet and/or outlet conduits, which is advantageous with respect to the design of the end pieces of the spiral heat exchanger.

According to a further embodiment of the invention, the centre body has a mainly cylindrical shape. In particular, the centre body may have a mainly circular cylindrically shape. Such a circular cross section shape enables a high strength and rigidity of the centre body and the spiral heat exchanger. Advantageously, the centre body has a substantially continuous outer surface. By such a continuous surface, which is uniform without any sharp recesses, sharp ridges or any other edges, an unobstructed flow and a high strength of the centre body may be obtained. Furthermore, the centre body may be substantially concentrical with respect to the centre axis.

According to a further embodiment of the invention the centre body is hollow. Thus, the weight of the spiral heat exchanger may be kept at a low level although the strength of the centre body may be maintained.

According to a further embodiment of the invention, the centre body extends along the centre axis a distance which corresponds to a main part of the width of the spiral sheets in the direction of the centre axis. Thereby, a rigid support for the spiral sheets in the centre of the spiral heat exchanger and an advantageous design of the flow channels in the centre part of the heat exchanger is obtained.

According to a further embodiment of the invention, the spiral heat exchanger includes two end pieces, wherein the spiral sheets and the centre body are arranged between the end pieces. Each end piece may include a centre aperture, through which the centre axis extends wherein each of said orifices is accessible through a respective one of said apertures.

According to a further embodiment of the invention, each of the spiral sheets is joined to the centre body along a line. Said joint lines may be substantially parallel to the centre axis and preferably positioned diagonally opposite to each other with respect to the centre axis.

BRIEF DESCRIPTION OF THE DRAWINGS

The present invention is now to be described more closely by means of different embodiments and with reference to the drawings attached, in which.

DETAILED DESCRIPTION OF DIFFERENT EMBODIMENTS OF THE INVENTION

Figure 1:
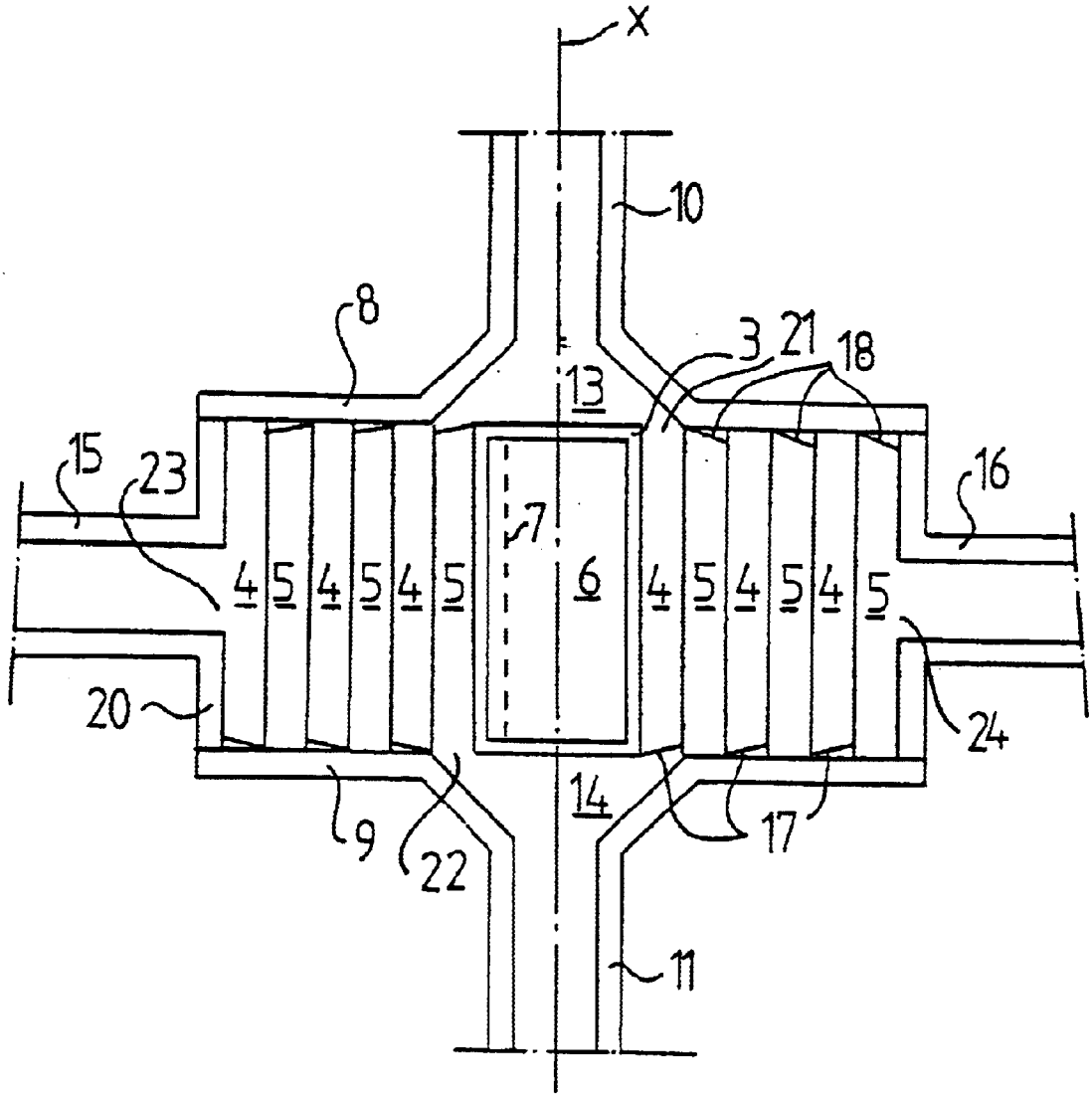
FIG. 1 is an axial sectional view of a spiral heat exchanger of a first embodiment of the invention.
Figure 2:
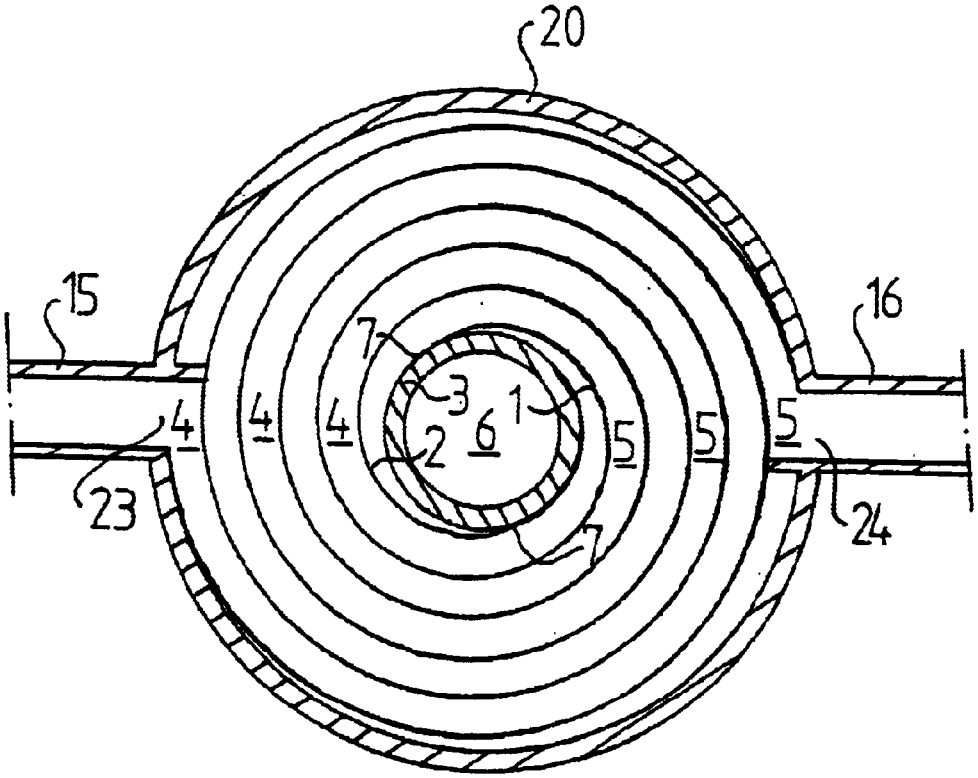
FIG. 2 is a radial sectional view of the spiral heat exchanger in FIG. 1.

FIGS. 1 and 2 discloses schematically a first embodiment of the spiral heat exchanger according to the invention. The heat exchanger includes two spiral metal sheets 1, 2 extending along a respective spiral-shaped path around a common centre axis x. The two spiral metal sheets 1, 2 are joined to a centre body 3 along a respective line 7, which are substantially parallel to the centre axis x. The lines 7 are positioned diagonally opposite to each other with respect to the centre axis x as appears from FIG. 2. The centre body 3 has a mainly circular cylindrical shape with a substantially continuous outer surface to which the two spiral sheets 1, 2 are joined. The spiral metal sheets 1, 2 may be joined to the centre body 3 by a weld along the respective line 7, although other joining methods may be used.

The two spiral metal sheets 1, 2 form two spiral-shaped flow channels 4, 5, which are substantially parallel to each other. Each flow channel permits a heat exchange fluid to flow in a substantially tangential direction with respect to the centre axis x. In other words, the main flow direction of the heat exchange fluid is along said spiral-shaped path.

The centre body 3 shown is hollow, i.e. includes a hollow inner space 6. Furthermore, the centre body 3 is closed, i.e. the inner space 6 is not accessible from any of the two flow channels 4, 5 or from the surrounding space. The pressure in the hollow inner space 6 may be chosen dependent on the particular circumstances, for instance it may be lower than the pressure in the flow channels 4, 5, especially a subatmospheric pressure. However, the pressure in the hollow inner space 6 of the centre body 3 may also be atmospheric or higher than the atmospheric pressure.

In the embodiment disclosed in FIG. 1, the centre body 3 extends along the centre axis x a distance which corresponds to the width of the spiral sheets 1, 2 in the direction of the centre axis x. The spiral heat exchanger includes two end pieces 8, 9 which in the embodiments disclosed are shaped as end plates. Each end piece 8, 9 includes a centre aperture From which a respective flow conduit 10 and 11, respectively, extends. The flow conduits 10, 11 are substantially coaxial with the centre axis x and extend in opposite directions with respect to each other.

Each flow channel 4, 5 has a radially inner orifice 21, 22 which permits communication between the respective flow channel 4, 5 and a respective inlet/outlet chamber 13 and 14. Each inlet/outlet chamber 13, 14 is positioned in such a manner that the centre axis x extends therethrough and is defined by means of the centre aperture and flow conduit 10, 11 of the respective end piece 8, 9 in the embodiment disclosed in FIG. 1. Furthermore, each flow channel 4, 5 includes a radially outer orifice 23, 24, which permits communication between the respective flow channel 4, 5 and a respective outlet/inlet conduit 15 and 16. Thus, a media may flow from a radially inner inlet/outlet chamber 13, 14 to the radially outer outlet/inlet conduit 15, 16 via the respective flow channel 4, 5 or in the opposite direction from the radially outer outlet/inlet conduit 15, 16 to the radially inner inlet/outlet chamber 13, 14. The first one 4 of the flow channels 4, 5 is closed at the end facing a second one 9 of the end pieces 8, 9 by means of a spiral metal strip 17. In the same way, the second flow channel 5 is closed at the end facing the first end piece 8 by a spiral metal strip 18. The metal strips 17, 18 may be welded to the spiral sheets 1, 2 in a manner known per se. Alternatively, the metal strips 17, 18 may be formed as an integral part of the spiral sheets 1, 2.

The spiral heat exchanger also includes an outer cylindrical shell 20, which may be substantially circular and to which the two outlet/inlet conduits 15, 16 are joined. As appears from the figures, the centre body 3 and the spiral metal sheets 1, 2 are enclosed within a casing formed by the shell 20 and the end pieces 8, 9.

In the embodiment disclosed in FIG. 1 and 2, the inlet/outlet chambers 13, 14 are formed by the flow conduits 10, 11 and the respective centre aperture of the end pieces 8, 9. The inlet/outlet chambers 13, 14 are circular in a radial cross-section and substantially concentric with respect to the centre axis x.

Figure 3:
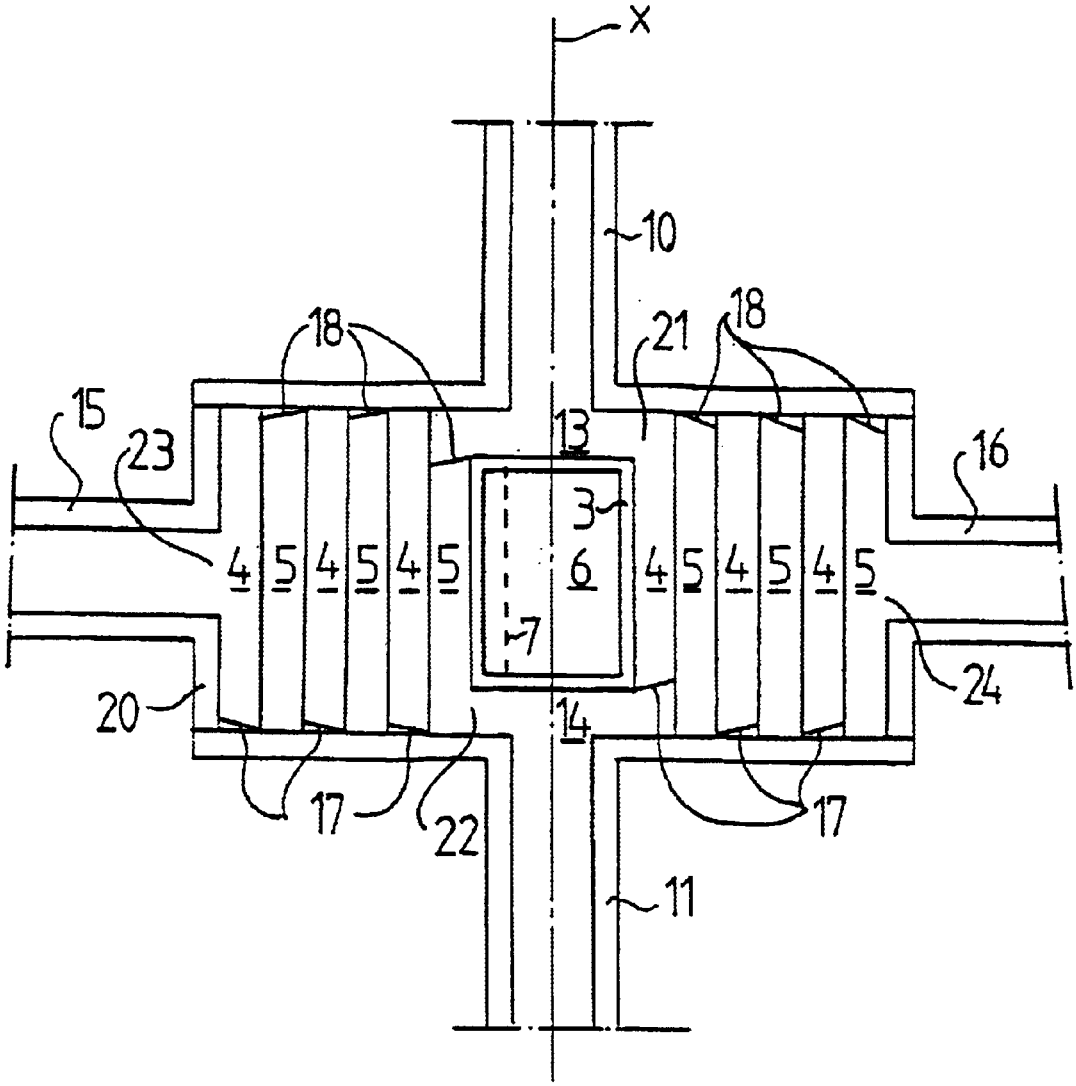
FIG. 3 is an axial sectional view of a spiral heat exchanger of a second embodiment of the invention.

FIG. 3 discloses a second embodiment of the present invention, which differs from the first embodiment in that the centre body 3 has a length along the centre axis x which is somewhat shorter than the width of the spiral sheets 1, 2 in the direction of the centre axis x. In the second embodiment the inlet/outlet chambers 13, 14 are provided between the end pieces 8, 9 and the centre body 3.

The present invention is not restricted to the embodiments disclosed but may be varied and modified within the scope of the following claims.

It is to be noted that the flow channels 4, 5 may have another design with respect to the two end areas facing a respective end piece 8, 9. For instance, all flow channels 4, 5 may be open, i.e. no metal strips 17, 18 are provided, wherein the flow channels 4, 5 are close to each other and the surrounding by means of the two end pieces 8, 9. Thereby, it is necessary to provide an arrangement or delimiting the inlet/outlet chamber 13, 14. Furthermore, it is possible to close the flow channels 4, 5 by means of metal strips 17, 18.

The end surfaces of the centre body 3 may have another shape than the substantially plane shape disclosed in the figures. For instance, the end surfaces may have a convex shape and in particular a semi-spherical shape.

What is claimed is:

1. A spiral heat exchanger including at least two spiral sheets (1, 2) extending along a respective spiral-shaped path around a common centre axis (x) and forming at least two spiral-shaped flow channels (4, 5), which are substantially parallel to each other, wherein each flow channel (4, 5) includes a radially outer orifice, which enables communication between the respective flow channel (4, 5) and a respective outlet/inlet conduit (15, 16) and which is located at a radially outer part of the respective flow channel (4, 5) with respect to the centre axis (x), and each flow channel (4, 5) includes a radially inner orifice, which enables communication between the respective flow channel (4, 5) and a respective inlet/outlet chamber (13, 14), so that each flow channel permits a heat exchange fluid to flow in a substantially tangential direction with respect to the centre axis (x), wherein the centre axis (x) extends through the inlet and outlet chambers (13, 14) adjoining the radially inner orifices, wherein the spiral heat exchanger includes a mainly circular, cylindrically shaped centre body (3) extending around the centre axis (x) and being substantially closed with respect to the flow channels (4, 5) and the inlet/outlet chambers (13, 14).

2. A spiral heat exchanger according to claim 1, wherein the inlet/outlet chamber (13, 14) at the radially inner orifice of one of the flow channels (4, 5) extends from said centre body (3) in one axial direction and the inlet/outlet chamber (13, 14) at the radially inner orifice of the other flow channel (4, 5) extends from said centre body (3) in the opposite axial direction.

3. A spiral heat exchanger according to claim 1, wherein the centre body (3) has a substantially continuous outer surface.

4. A spiral heat exchanger according to claim 1, wherein the centre body (3) is substantially concentrical with respect to the centre axis (x).

5. A spiral heat exchanger according to claim 1, wherein the centre body (3) is hollow (6).

6. A spiral heat exchanger according to claim 1, wherein the centre body (3) extends along the centre axis (x) a distance which corresponds to a main part of a width of the spiral sheets (1, 2) along the centre axis (x).

7. A spiral heat exchanger according to claim 1, wherein the spiral heat exchanger includes two end pieces (8, 9), wherein the spiral sheets (1, 2) and the centre body (3) are arranged between the end pieces (8, 9).

8. A spiral heat exchanger according to claim 7, wherein each end piece (8, 9) has a centre aperture, through which the centre axis (x) extends.

9. A spiral heat exchanger according to claim 1, wherein each of the spiral sheets (1, 2) is joined to the centre body along a line (7).

10. A spiral heat exchanger according to claim 9, wherein each of the lines (7) is substantially parallel to the centre axis (x).

11. A spiral heat exchanger according to claim 9, wherein each of the lines (7) is positioned diagonally opposite to each other with respect to the centre axis (x).

* * * * *